United States Patent [19]

Sambus

[11] 3,973,507

[45] Aug. 10, 1976

[54] WORK GUIDE APPARATUS FOR A SEWING MACHINE

[76] Inventor: Joseph P. Sambus, 1079 Mosefan St., Franklin Square, N.Y. 11010

[22] Filed: June 16, 1975

[21] Appl. No.: 586,882

[52] U.S. Cl. ..... 112/136; 112/75; 112/152

[51] Int. Cl.[2] ..... D05B 35/12

[58] Field of Search ..... 112/121.15, 121.11, 112/121.12, 136, 152, 75; 33/190, 189

[56] References Cited

UNITED STATES PATENTS

| | | | |
|---|---|---|---|
| 2,209,371 | 7/1940 | Zablocki | 112/121.15 |
| 2,560,705 | 7/1951 | Singer | 112/75 |
| 2,703,931 | 3/1955 | Collins | 112/136 X |
| 3,203,385 | 8/1965 | Micale | 112/152 |

FOREIGN PATENTS OR APPLICATIONS

| | | | |
|---|---|---|---|
| 970,575 | 6/1950 | France | 112/75 |
| 787,752 | 12/1957 | United Kingdom | 112/75 |

*Primary Examiner*—H. Hampton Hunter
*Attorney, Agent, or Firm*—Bucknam and Archer

[57] ABSTRACT

A work guide apparatus for a sewing machine providing a plate moveable in guided engagement with guide means attached to a base surface of the sewing machine. The plate carries a work piece along a path of motion relative to the sewing machine needle, with plate movement being limited by adjustable stop means to correspondingly limit the stitching length. Gauge means extending across the plate accommodates positioning portions of the work piece in a selected spatial relation to a reference line on the plate to control the location of the stitching as required in tacking, pleating, measuring and sizing of draperies.

12 Claims, 4 Drawing Figures

WORK GUIDE APPARATUS FOR A SEWING MACHINE

BACKGROUND AND SUMMARY OF THE INVENTION

This invention relates in general to equipment and accessories for sewing machines, and more particularly to a work guide apparatus for a sewing machine that can be used for performing various tacking and pleating sizing and other operations.

In the prior art, especially in the manufacture of draperies, tacking and pleating sewing operations have been performed with the work piece being guided by hand and after the stitching path had been marked, and with the aid of pinning or staples.

While certain accessory equipment, such as represented by U.S. Pat. No. 2,209,371 to E. C. Zablocki and U.S. Pat. No. 2,588,886 to L. Schwartz, have been devised for performing special sewing operations, such equipment is of little use in performing the variety of controlled stitching operations required in the manufacture of pleated drapes.

The work guide apparatus of the subject invention has guide means that are attached to a base surface of the sewing machine, and a plate moveable in guided engagement with the guide means. This plate serves to carry a work piece along a corresponding path of motion with respect to the needle path of the sewing machine. Adjustable stop means operate to limit the movement of the plate at a selected position along its movement path to correspondingly limit the stitching length effected by the sewing machine needle. Movement of the plate is accomplished by an operator holding the work piece against the plate and pushing. Gauge means extending across the plate accommodate positioning portions of the work piece in a selected spatial relation to a reference line on the plate to thereby control the location of the stitching effected by the needle.

According to a preferred embodiment of the invention the gauge means is connected to the plate for support thereby and movement therewith, and includes two adjustable gauges, one for pleating and another for spacing pleats.

The plate has an elongated slot accommodating the extension therethrough of the sewing machine needle.

Expediently, the stop means includes a stop bar supported in overlying relation to the plate and a contact member carried by the plate and disposed for engagement with the stop bar to arrest the plate against further forward movement. A frame is provided with multiple, spaced holding means to receive the stop bar and support it in a variety of preselected positions, which preferably correspond to standard stitching lengths.

The gauge means and stop means together enable an operator to make a given combination of pleat depth, inter-pleat space, and length settings, and then merely advance the work on the plate repeatedly, setting the work against the gauges for each successive pleat, in order to get a drape product in which the pleats are of uniformly good quality.

For a better understanding of the invention and its several advantages, reference should be had to the following detailed description and accompanying drawings which together exemplify a preferred embodiment of the invention.

THE DRAWINGS

DESCRIPTION OF A PREFERRED EMBODIMENT OF THE INVENTION

Figure 1:
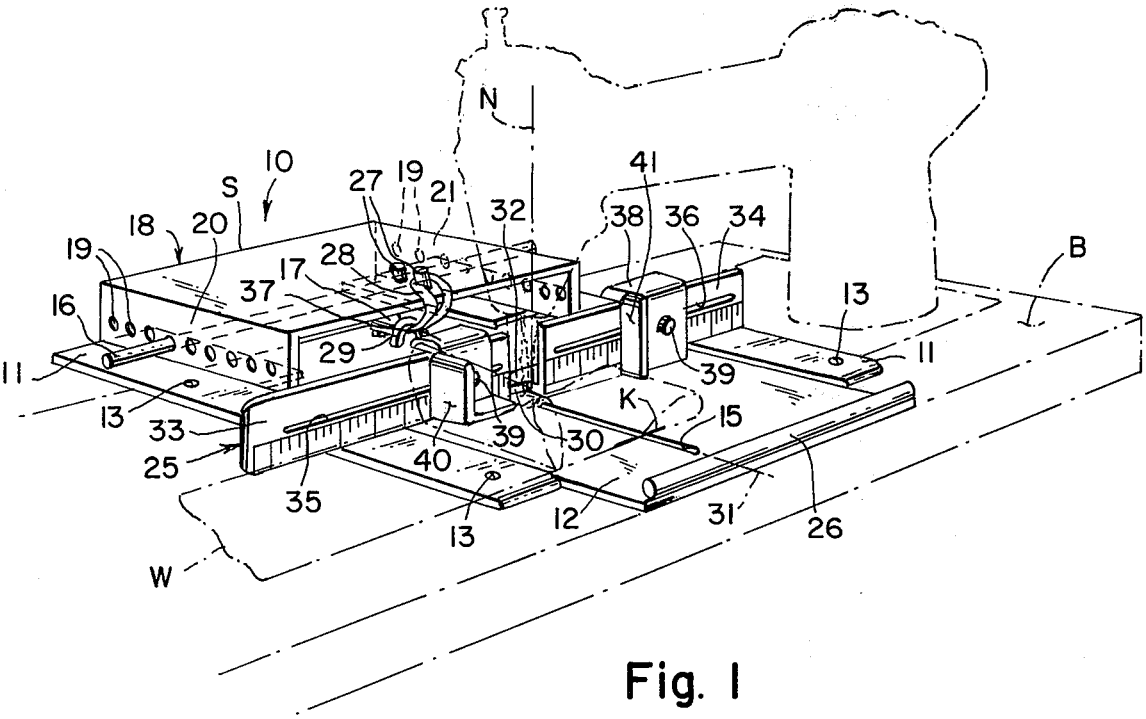
FIG. 1 is a perspective view of a work guide apparatus according to a preferred embodiment of the invention, shown as installed on a typical sewing machine for use in connection therewith, the sewing machine being shown in phantom.
Figure 2:
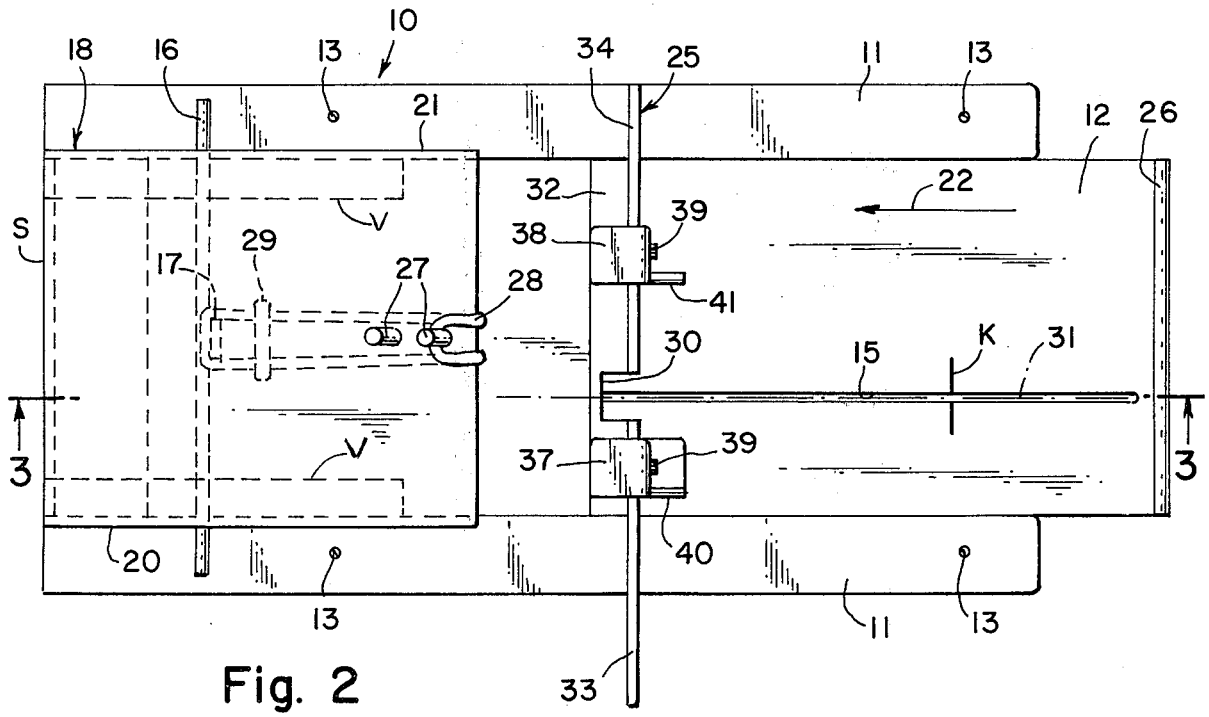
FIG. 2 is a plan view of the work guide apparatus shown in FIG. 1.
Figure 3:
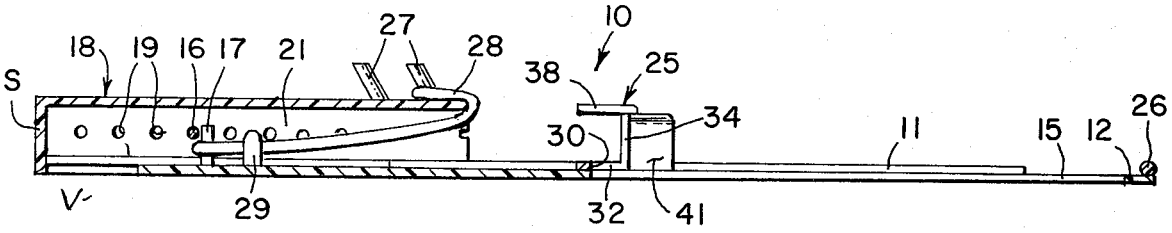
FIG. 3 is a vertical sectional view of the work guide apparatus shown in FIG. 2 as taken along line 3—3 therein.

FIGS. 1 through 3 exemplify a work guide apparatus 10 which is used in conjunction with a typical conventional sewing machine (shown in phantom) to perform on a workpiece W stitching operations of the type frequently used in the making of pleated drapes. In the making of pleated drapes there is the need for sewing the drape material within a limited width region extending across what is to be normally the upper edge of the finished drape. The width of such region commercially varies in accordance with standard widths of backing material used thereat and is typically within the range of 1 to 6 inches. The pleats of the drape are normally stitched along paths extending across this backed region and perpendicular to the drape upper edge. Typically, the pleats are desirably made with a uniform pleat loop size and a uniform inter-pleat spacing. The work guide apparatus 10 allows a relatively unskilled operator to make drapes with uniform pleat loop size and spacing, simply by placing the material against suitably positioned gauges on a moveable carrier plate.

Apparatus 10 has guide means, expediently in the form of a pair of generally parallel guide bars 11 that are attached to a base surface B of the sewing machine by screws 13.

Each bar 11 is disposed for sliding contact engagement with a respective edge of a generally rectangular carrier plate 12. Plate 12 is thus moveable in guided engagement with bars 11, and over the base surface B, to carry work piece W along a corresponding path of motion with respect to the needle path N of the sewing machine. This path is of course straight and in the same direction as the lengthwise direction of the contacting edges of bars 11 and plate 12. An elongated slot 15 is provided in plate 12 parallel to bars 11 to accommodate the extension through plate 12 of the sewing machine needle.

The stitching length effected by the sewing machine needle corresponds to the travel of plate 12, and the invention provides adjustable stop means operable to limit the movement of plate 12 at a selected position along the movement path thereof. Expediently such stop means includes a stop bar 16 supported in overlying relation to the back portion of plate 12, and a contact member 17 carried by plate 12 and extending thereabove for engagement with stop bar 16. For adjustability of stop bar 16, there is provided a box-like frame 18 connected to guide bars 11 for support thereby, and a series of aligned pairs of apertures 19 through respective sides 20, 21 of frame 18. The stop bar 16 is extended through frame 18 and received in a selected pair of apertures 19 and is thereby supported in a corresponding fixed position such that when contact member 17 bears against bar 16 further movement of plate 12 in the forward direction indicated by arrow 22 is halted.

The number and spacing of the pairs of apertures 19 can be varied to suit the needs of a particular application, but it is suggested that the pairs of apertures be identified with appropriate markings on the frame sides 20, 21 so that the operator can readily identify where the stop bar 16 must be placed for a given stitching length.

Frame 18 has a back plate S which extends downward into the path of movement of plate 12 so that if the stop bar 16 is not used, the leading edge of plate 12 will abut against plate S. This is utilized to facilitate calibration of te device 10 when it is installed. On plate 12 is provided a scribed reference mark K which is set at a calibrated distance from the leading edge of plate 12. To calibrate a maximum stitching length, plate 12 is pushed forward until its leading edge abuts plate S, and then with the plate 12 held in such abutment, the sewing machine needle is set through slot 15 at the location of mark K. With the device 10 held at such location, screws 13 are driven into the base B. The device 10 will therefore operate over its full stitching length range and the spacings of apertures 19 will be properly located with respect to the needle path N.

In normal operation of the apparatus 10 in conjunction with the sewing machine, the operator holds the work piece W on plate 12, usually against some part of a gauge means 25, and pushes the plate 12 forward until it is halted by stop bar 16. To facilitate pushing plate 12, a bar 26 is attached to the end portion of the plate 12.

The plate 12 is preferably connected to resilient means that are operable to bias the plate 12 for return to a predetermined reference position. For such purpose there is provided on frame 18 one or more posts 27 around one of which is looped a rubber band 28 that passes under a hold-down ring-piece 29 attached to plate 12, and is looped around the contact member 17. The size of band 28 is chosen so that it will be in tension and exert sufficient force upon contact member 17 as to urge the plate 12 back to a reference position which expediently is established by engagement of surface 30 of the gauge means 25 with the back of the sewing machine presser foot.

Gauge means 25 extends across plate 12 to accommodate positioning portions of the work piece W in a selected spatial relation to a reference line 31 on plate 12 which is parallel to the movement direction thereof and intersects the needle path N. The gauge means 25 is connected to plate 12 for support thereby in overlying relation thereto, and expediently includes a horizontal member 32 attached to plate 12, and a pair of verticaly extending bars 33, 34 connected to plate 12 and/or member 32. Bars 33, 34 are provided with respective elongated slots 35, 36 and carry respective gauge pieces 37, 38. Each gauge piece 37, 38 can be adjustably shifted along its associated bar 33, 34 and locked in a selected position thereon by means of releasable nut and bolt connections 39 which pass through respective slots 35, 36.

To facilitate use by the operator, bars 33 and 34 are provided with printed scales that are indicative of the distances from reference line 31, or the sewing path, of the face 40 on gauge piece 37 and the face 41 on gauge piece 38.

While the gauge pieces 37 and 38 can be used for other measuring purposes, it has been found advantageous to use the gauge piece 37 for controlling the interspacing between consecutive pleats of a drape, and to use the gauge piece 38 for controlling the pleat loop size. Thus, the invention provides a gauge means 25 including a pair of adjustable gauges 37, 38 each independently moveable along a path defined by respective bars 33, 34 and slots 35, 36 which path is confined to one respective side of reference line 31.

The work guide apparatus 10 offers the advantage that the work piece W is on the plate 12 in front of the gauge means 25, and as the gauge means moves with the plate 12 relative to the sewing needle, there is little chance of the work shifting out of its preset position. Typically the edge of the work is held against the collinear aligned bars 33, 34 to use the scales thereon, and the sewing path line 31 is generally perpendicular to the bars 33, 34.

Figure 4:
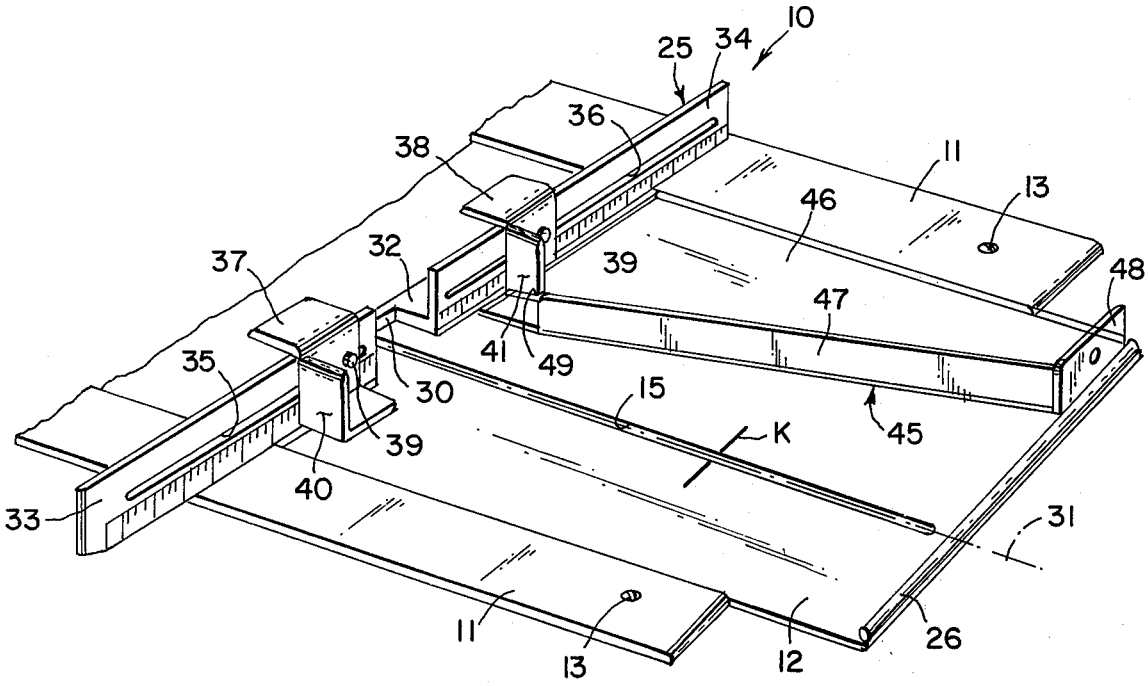
FIG. 4 is a perspective view of the work guide apparatus shown in FIG. 1 as seen with a special guide installed upon the moveable plate to facilitate making diagonal tack stitches.

However, there are some sewing operations in which it is desired to stitch along lines that are inclined at a predetermined angle to the edge of the workpiece. For such cases, the invention provides an auxiliary gauge 45 shown in FIG. 4 as used in connection with the apparatus 10.

Gauge 45 has a generally flat base plate 46 that is laid against the carrier plate 12, and fence bar 47 that extends generally perpendicular to plate 46 and is connected thereto edgewise. A brace bar 48 is connected to plate 46 and to fence bar 47 to stabilize same. Base plate 46 is so dimensioned as to fit between the pleat scale bar 34 and the push bar and preferrably against the right guide bar 11. Expediently, plate 46 has a notch 49 arranged to receive the extending part of gauge piece 38 bearing face 41. With gauge piece 38 locked by connection 39 in the position shown by FIG. 4, the auxiliary gauge is secured in place upon carrier plate 12. To use the auxiliary gauge 45, an edge of the workpiece is laid against the fence bar 47 and the carrier plate 12 is advanced as the sewing machine needle operates. The angle at which fence bar 47 is inclined with respect to the stitching ine 31 can, of course, be varied as desired, and different auxiliary gauges similar to the gauge 45 can be provided, each such gauge having a fence bar 47 set at a selected different angle with respect to line 31.

Angular markings are scribed into plate 12, typically at 30°, 45° and 60° lines with respect to the movement line 31. The angle gauge 45 is set over the proper marking before fastening 39 is tightened. If for some reason, the gauge 45 is not used, the work can be advanced along the selected marking line to make a corresponding angle tack. As desired scribed markings for any selected angles can be provided on plate 12.

Movement of the carrier plate 12 can be effected by the sewing machine dogs which normally underly plate 12, or it can be advanced manually by the operator as when the sewing machine dogs are set into a retracted, inoperative position.

It will be appreciated by the artisan that some of the details of the apparatus 10 can be varied while still preserving the basic concepts thereof. For example, the carrier plate 12 is shown as being biased to return to a reference position by a rubber band 28 that is connected to the plate around the same contact member 17 used for engaging the stop bar 16. The rubber band 28 could be otherwise connected to the carrier plate 12, or other biasing means could be used. Because of the choice of the rubber band 28, and particular connection thereof to plate 12, a pair of holddown bars V connected to frame 18 and/or respective guide bars 11 are arranged to slidably contact the back portion of plate 12 to prevent same from lifting up away from base surface B due to forces exerted by the band 28. Any other suitable conventional means for restraining plate 12 from lifting away from base surface B, without interferring with the sliding movement of plate 12 can be substituted.

While any suitable conventional materials can be used for construction of the work guide apparatus 10, it has been found satisfactory to make the guide bars 11, plate 12, gauge means 25, frame 18, conact member contact and other parts out of a plastic, such as plexiglass.

While the invention contemplates the plate 12 and attached gauge means 25 being moveable along guide bars 11 to perform sewing of pleats, which have been determined as to interpleat spacing and loop size by the gauge pieces 37 and 38, it is entirely possible to use the combination of plate 12 and gauge means 25 separately and apart from the guide bars 11 and sewing machine. Such separate use, of course, will allow the artisan to determine the spacing and loop size of pleats to be formed in a work piece laid upon plate 12, and once such determinations have been made, the work piece can be marked and either pinned or stapled together to hold the pleat form while it is sewn at some other work station.

From the foregoing description of a preferred embodiment of the invention the artisan should realize that the invention is adaptable to numerous modifications and variations as will become obvious from the disclosure herein.

What is claimed is:

1. A work guide apparatus for a sewing machine which comprises guide means disposed for attachment to a base surface of the sewing machine, a plate moveable in guided engagement with said guide means over said base surface to carry a work piece along a corresponding path of motion with respect to the needle path of the sewing machine, adjustable stop means operable to limit the movement of said plate at a selected position along the movement path thereof to correspondingly limit the stitching length effected by the sewing machine needle, and gauge means extending across said plate to accommodate positioning portions of the work piece in a selected spatial relation to a reference line on the plate to thereby control the location of the stitching effected by said needle.

2. A work guide apparatus according to claim 1 wherein said gauge means includes an adjustable gauge moveable along a path confined to one side of said reference line.

3. A work guide apparatus according to claim 1 wherein said gauge means includes a pair of adjustable gauges each independently moveable along a path confined to one respective side of said reference line.

4. A work guide apparatus according to claim 1 wherein said stop means includes a stop member supported in overlying relation to said plate and a contact member carried by said plate and disposed for engagement with said stop member.

5. A work guide apparatus according to claim 1 including resilient means connected to said plate and operable to bias same for return to a predetermind reference position.

6. A work guide apparatus according to claim 1 wherein said plate has a slot accommodating the extension therethrough of the sewing machine needle.

7. A work guide apparatus according to claim 1 wherein said guide means includes a pair of generally parallel guide bars each disposed for sliding contact engagement with a respective edge of said plate.

8. A work guide apparatus according to claim 7 wherein said gauge means is connected to said plate for support thereby in overlying relation thereto.

9. A work guide apparatus according to claim 7 including a frame connected to said guide bars for support thereby and extending in overlying relation across said plate, said frame having means to receive and support a stop bar of said stop means.

10. A work guide apparatus according to claim 9 wherein said frame has a series of spaced apertures to receive said stop bar in any one of a corresponding plurality of fixed positions.

11. A work guide apparatus according to claim 1 wherein said gauge means includes a gauge carried by said plate and having a surface disposed at an angle with respect to said reference line.

12. A work guide apparatus according to claim 3 wherein one of said gauges establishes the spacing between successive pleats to be formed in the work piece, and the other of said gauges establishes the loop size of such pleats.

* * * * *